US011555370B2

(12) United States Patent
Monjure et al.

(10) Patent No.: US 11,555,370 B2
(45) Date of Patent: Jan. 17, 2023

(54) SUBSEA CASING HANGER RUNNING TOOL WITH ANTI-ROTATION FEATURE AND METHOD FOR ROTATING CASING INTO COMPLEX AND DEVIATED WELLBORES

(71) Applicant: Baker Hughes Oilfield Operations LLC, Houston, TX (US)

(72) Inventors: Noel Monjure, Houston, TX (US); David L. Ford, Houston, TX (US); Steve Peters, Houston, TX (US); Phil Potter, Houston, TX (US); James Sonnier, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/011,623

(22) Filed: Sep. 3, 2020

(65) Prior Publication Data

US 2021/0062604 A1 Mar. 4, 2021

Related U.S. Application Data

(60) Provisional application No. 62/895,783, filed on Sep. 4, 2019.

(51) Int. Cl.
*E21B 33/043* (2006.01)
*E21B 33/04* (2006.01)

(52) U.S. Cl.
CPC ..... *E21B 33/043* (2013.01); *E21B 33/0415* (2013.01)

(58) Field of Classification Search
CPC ..... E21B 23/02; E21B 33/043; E21B 33/0415
See application file for complete search history.

(56) References Cited

U.S. PATENT DOCUMENTS

| | | | | |
|---|---|---|---|---|
| 4,928,769 | A * | 5/1990 | Milberger | E21B 33/043 166/212 |
| 4,944,345 | A | 7/1990 | Mashaw, Jr. | |
| 5,020,593 | A * | 6/1991 | Milberger | E21B 33/043 285/123.4 |
| 9,689,229 | B2 * | 6/2017 | Hanson | E21B 33/14 |
| 10,513,898 | B2 * | 12/2019 | Allamon | E21B 43/10 |
| 2001/0045288 | A1 | 11/2001 | Allamon | |
| 2009/0159268 | A1 | 6/2009 | Fay | |
| 2011/0031020 | A1 | 2/2011 | Cote | |
| 2012/0018172 | A1 | 1/2012 | Javed | |

(Continued)

OTHER PUBLICATIONS

International Search Report and Written Opinion dated Nov. 23, 2020 in corresponding PCT Application No. PCT/US20/49341.

*Primary Examiner* — Aaron L Lembo
(74) *Attorney, Agent, or Firm* — Hogan Lovells US LLP

(57) ABSTRACT

A downhole tool for transmitting rotation to a casing string includes a tool body having a bore extending from a first end to a second end. The downhole tool also includes a cam positioned within the tool body, the cam being axially translatable along an axis of the bore. The downhole tool further includes a recess, formed in an outer diameter of the cam. The downhole tool includes a locking mechanism, positioned at least partially within the tool body. The locking mechanism includes a tool key. The locking mechanism also includes a biasing member, the biasing member driving the tool key toward the retracted position.

7 Claims, 11 Drawing Sheets

(56) References Cited

U.S. PATENT DOCUMENTS

| | | | | |
|---|---|---|---|---|
| 2012/0067595 | A1* | 3/2012 | Noske | E21B 34/14<br>166/334.4 |
| 2015/0041151 | A1* | 2/2015 | Cocker, III | E21B 33/0415<br>166/380 |
| 2015/0114667 | A1 | 4/2015 | Mansukh | |

* cited by examiner

SUBSEA CASING HANGER RUNNING TOOL WITH ANTI-ROTATION FEATURE AND METHOD FOR ROTATING CASING INTO COMPLEX AND DEVIATED WELLBORES

CROSS-REFERENCE TO RELATED CASES

This application claims priority to and the benefit of U.S. Provisional Application Ser. No. 62/895,783 filed Sep. 4, 2019 titled "Subsea Casing Hanger Running Tool with Anti-rotation Feature and Method for Rotating Casing into Complex & Deviated Wellbores", the full disclosure of which is hereby incorporated herein by reference in its entirety for all purposes.

BACKGROUND

1. Field of the Disclosure

The present disclosure relates to subsea downhole exploration systems. Specifically, the present disclosure relates to subsea casing hanger running tools and casing hangers with casing torque and anti-rotation features.

2. Description of Related Art

Deviated and complex wellbores, especially in subsea and deep water applications, present a new set of problems for traditional subsea casing hanger running tools. Conventional subsea casing hanger running tools are assembled to subsea casing hangers using rotation to engage a cam actuated feature that locks the casing string to the running tool. Under normal well bore conditions, the heavy weight of the casing string provides sufficient friction across the thread form to provide a modest, but variable, level of anti-rotation. In deviated, complex well bores, however, the pipe weight is greatly reduced. This is in part due to "sticking" while trying to manipulate the casing string through "tight hole" sections of the bores. The resulting loss of weight and torque buildup tends to force unplanned rotation of the casing hanger running tool and can lead to release of the cam actuated locking mechanism.

SUMMARY

Applicants recognized the problems noted above herein and conceived and developed embodiments of systems and methods, according to the present disclosure, for subsea casing hangers and running tools.

In an embodiment, a downhole tool for transmitting rotation to a casing string includes a tool body, the tool body having a bore extending from a first end to a second end. The downhole tool also includes a cam positioned within the tool body, the cam being axially translatable along an axis of the bore. The downhole tool further includes a recess, formed in an outer diameter of the cam, the recess having a smaller recess diameter than a planar section of the outer diameter. The downhole tool includes a locking mechanism, positioned at least partially within the tool body. The locking mechanism includes a tool key, the tool key being movable between a retracted position where at least a portion of the tool key is positioned within the recess and an extended position where at least a portion of the tool key extends radially outward beyond a tool diameter. The locking mechanism also includes a biasing member, the biasing member driving the tool key toward the retracted position.

In another embodiment, a system for running casing includes a tool string, a running tool, coupled to the tool string, and a casing torque tool, coupled to the running tool. The casing torque tool is configured to releasably engage at least a portion of a casing string and includes a translatable cam within a casing torque tool bore, the cam having a recess formed in an outer diameter and a notch formed in the inner diameter. The casing torque tool also includes a tool key adapted to move radially with respect to the casing torque tool bore, the tool key bearing against at least a portion of the translatable cam and, in response to movement of the translatable cam, transitioning between a retracted position and an extended position. The casing torque tool further includes a pin adapted to move radially with respect to the casing torque tool bore, the pin translating into the casing torque tool bore in response to being at least partially aligned with the recess.

In an embodiment, a method for transmitting a rotational force includes arranging a downhole tool, having a locking mechanism, proximate a locking profile associated with a casing string. The method also includes engaging a cam of the downhole tool via a surface tool. The method further includes moving the cam in an axially upward direction to transition the cam from a first position to a second positon, the locking mechanism contacting the locking profile when the cam is in the second position. The method includes securing the cam in the second position. The method also includes transmitting a rotational force applied to the downhole tool to the casing string.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
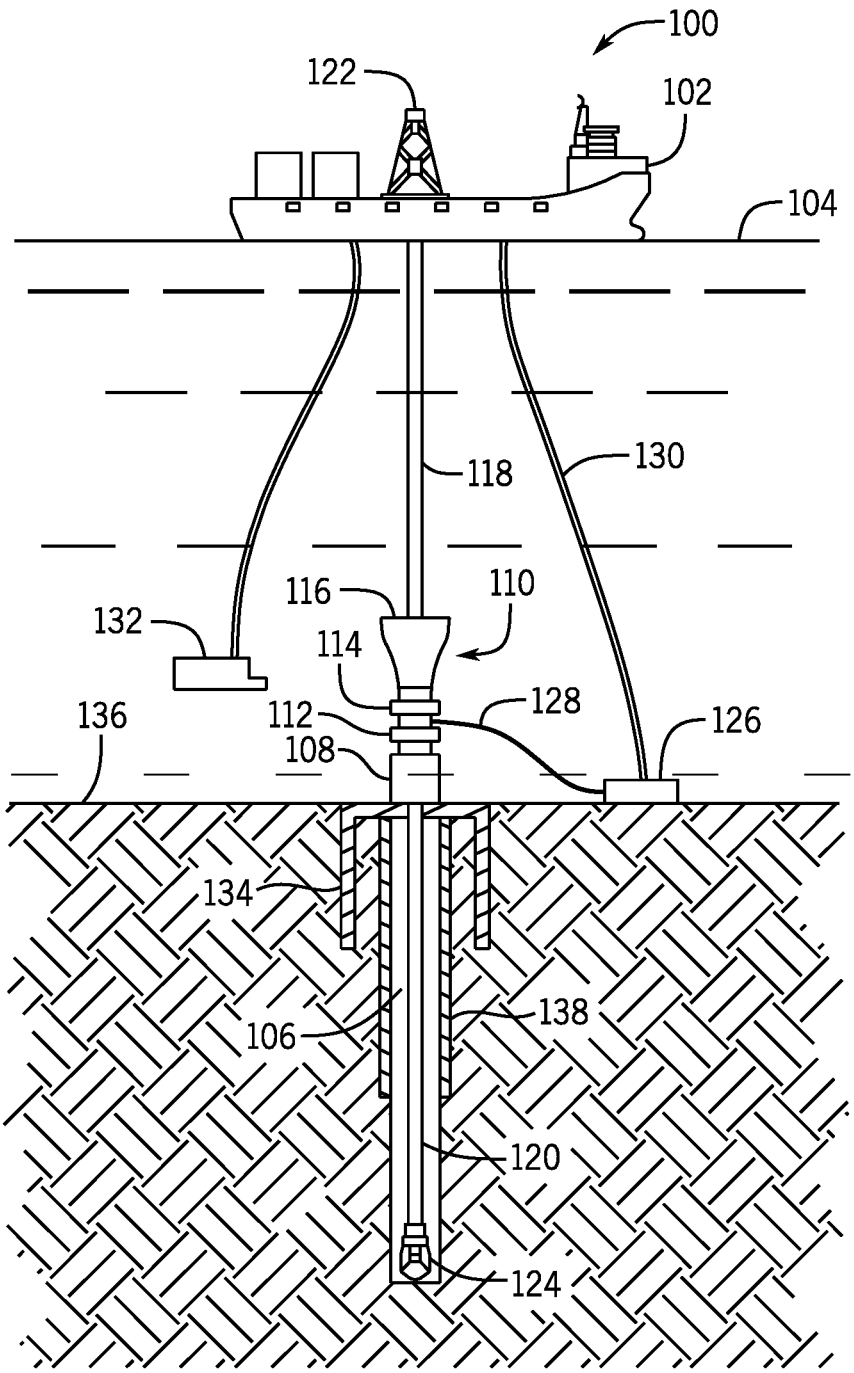
FIG. 1 is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure are directed to overcome the above-recognized problems for installation of subsea casing strings. With the proliferation of complex and highly deviated well bores, especially in deep water, stuck pipe situations are becoming more common. Known methods to release stuck pipe, such as, for example, weight down or washing, are not successful in remedying the problem. Accordingly, embodiments of the present disclosure are directed toward systems and methods that may also enable the ability to rotate the casing string to facilitate landing the casing string properly while reducing the risk of subsea assemblies sticking across the blowout preventer (BOP) and ram assemblies.

Embodiments of the present disclosure provide the ability to rotate the subsea casing string into deviated and/or complex wellbores to prevent stuck pipe. As will be described herein, a combination of tooling and methodology reduces or prevents torque buildup between the wellbore, casing string, and surface that could be transferred to the makeup threads of subsea casing hanger running tools, thus impairing normal performance. Embodiments may add an extension, device or tool, below the casing hanger running tool that uses a series of slips, spears, grapples, specialized locking profile or other torque transfer features to engage and lock onto the inner wall of the casing string, the inner wall of a casing sub, or the internal profile of the casing hanger. Right hand rotation, or, alternately, left hand rotation, can increase the bite or friction and engagement of the device to the casing joint, casing hanger or casing hanger extension to allow transfer of torque from the surface rotating equipment of the rig, or other torque transferring machinery, into the casing string without premature forced rotation of the casing hanger running tool. This allows the casing to be rotated into the tight-hole section, along with simultaneous and near-simultaneous weight down and washing with drilling fluids or water, to minimize or eliminate the risk of stuck casing. It should be appreciated that embodiments further enable subsequent (e.g., in series) performance of various methods to free stuck casing.

In various embodiments, an enhanced subsea casing hanger running tool with an anti-rotation device may be incorporated into a downhole tool. By way of example, embodiments may include a landing string assembly with a Pressure Assist Drill Pipe Running Tool (PADPRT) with the hanger and integral torque sub and casing seal assembly. The casing seal, casing hanger and other components, including a casing torque device are pre-made up in the casing joint assembly and locked to prevent rotation. The assembly can be racked prior to running the casing string into the bore. One method of operating the device includes running the device into the bore with the casing string and the landing string assembly. When a tight-hole section is encountered, options for continuing to lower casing string can include 1) setting down weight, 2) circulating drilling fluid to wash the annulus and reduce sticking friction, and/or 3) rotating the casing string and landing string assembly using a top drive or rotary land casing hanger and landing string assembly in the subsea high pressure wellhead assembly. It should be appreciated that these options may be performed sequentially and/or at the same time. Furthermore, one or more of these options may be performed. Further steps can include dropping a ball and unlocking the casing torque spear, then cementing the casing as specified and rotating the landing string assembly (e.g., turn right to release). Next, the operator can lower the landing string so the weight down carries the packoff into the setting position and energizes bulk rubber seal on the tool.

Embodiments of the present disclosure may also include the operator closing the BOP and other pressure through the choke and kill lines to fully set annular seal, overpull the strips setting sleeve off of packoff, and retract the stem. The packoff seal can then be pressure tested through the choke and kill lines. Right-hand turns release the tool from the casing hanger for recovery from the bore. Finally, the operator can pick up the landing string with a casing torque spear.

As will be described herein, embodiments of the present disclosure incorporate direct drive from drill pipe landing string to a casing torque or anti-rotation device added below the PADPRT casing hanger assembly. Accordingly, embodiments provide numerous advantages over known systems, including by way of example only the ability to apply right hand torque directly to the inner diameter of the casing string and reduce or prevent rotation from the casing string due to residual torque across the running tool; the ability to apply right hand torque to an extension of the casing hanger body or heavy wall casing sub for greater torque without deformation of the casing wall; and the ability to apply right hand or left hand torque, and enable anti-rotation prevention with an engineered casing hanger profile, or casing hanger extension sub profile and an interfacing tool with ribs, splines or grooves to transmit torque and prevent rotation.

Embodiments may also utilize various systems and methods with the PADPRT, including but not limited to running the PADPRT into the borehole with the casing; making up the casing hanger (this can be done in advance); picking up the PADPRT bottom hole assembly with a spear and emergency release sub; engaging the PADPRT bottom hole assembly with the casing hanger; engaging the spear with the casing; running into the borehole with the landing string assembly; rotating, washing, and/or pushing the casing down as needed; landing out the casing hanger; releasing the spear from the casing or the casing torque sub; cementing the casing; releasing the PADPRT bottom hole assembly; and pulling out of the hole, leaving the laid down PADPRT bottom hole assembly.

FIG. 1 is a side schematic view of an embodiment of subsea drilling operation 100. The drilling operation includes a vessel 102 floating on a sea surface 104 substantially above a wellbore 106. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation.

In various embodiments, different sections of casing may be installed within the wellbore 106, with subsequent casing diameters being smaller than the preceding casing diameter. For example, the casing may be suspended from a hanger installed within the system and then cement may be pumped through the casing to secure the casing to the underground formation. While the illustrated embodiment includes a substantially straight (e.g., vertical) wellbore 106, it should be appreciated that wellbores 106 may be deviated such that bends and the like are included along a length of the wellbore 106. As noted above, deviated wellbores may be more challenging for drilling and casing operations because as subsequent sections of casing are run downhole, the casing may become stuck at the bends, which is undesirable. The above-described methods of releasing the casing have proven unreliable, even more so in deviated wellbores, and accordingly systems and methods of the present disclosure may be utilized to provide additional capabilities for overcoming the present problems seen in the industry.

Figure 2:
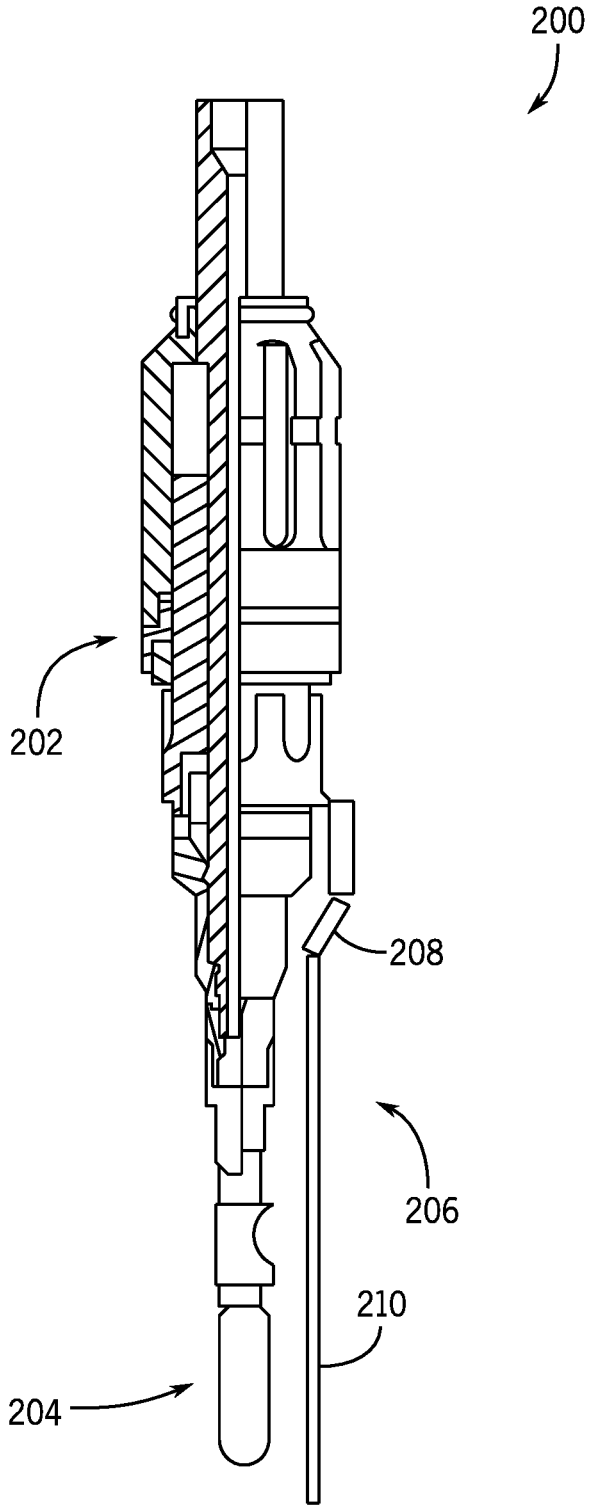
FIG. 2 is a partial schematic view of an embodiment of a tool system, in accordance with embodiments of the present disclosure.

FIG. 2 is a schematic partial view of an embodiment of a tool system 200. The illustrated running tool system includes the PADPRT 202. The illustrated PADPRT 202 is a pressure-assist drill pipe running tool that enables casing string to be hung under the wellhead and also may include a single trip running tool to test both the casing hanger and the annulus seal. In this example, the tool system 200 includes a releasable casing torque device (RCTD) 204 attached at an end 206 of the PADPRT 202. In this example, the end 206 may be referred to as a downhole end. In other words, the end 206 is opposite a connection to a surface location and is axially lower and/or closer to a borehole bottom.

The illustrated system 200 is positioned within the wellbore 106, which includes a casing hanger 208 and a section of casing 210 extending into the wellbore 106 from the hanger 208. In various embodiments, the casing 210 is suspended from the hanger 208 and may be secured to the formation via a cementing operation. In various embodiments, the hanger 208 may be part of a casing torque sub.

As will be described below, in various embodiments the RCTD 204 and the PADPRT 202 are pre-made up in a casing joint and locked for anti-rotation. The assembly may be racked prior to running the casing string into the wellbore, which may also include a landing string assembly. Thereafter, wellbore operations may commence by running the string downhole, landing the casing hanger and landing string assembly in a subsea high pressure wellhead assembly. As noted above, operations may encounter a tight hole section there the assembly may be stuck. Embodiments of the present disclosure may utilize the RCTD 204 to enable rotation of the casing string using a top drive or rotary.

Figure 3:
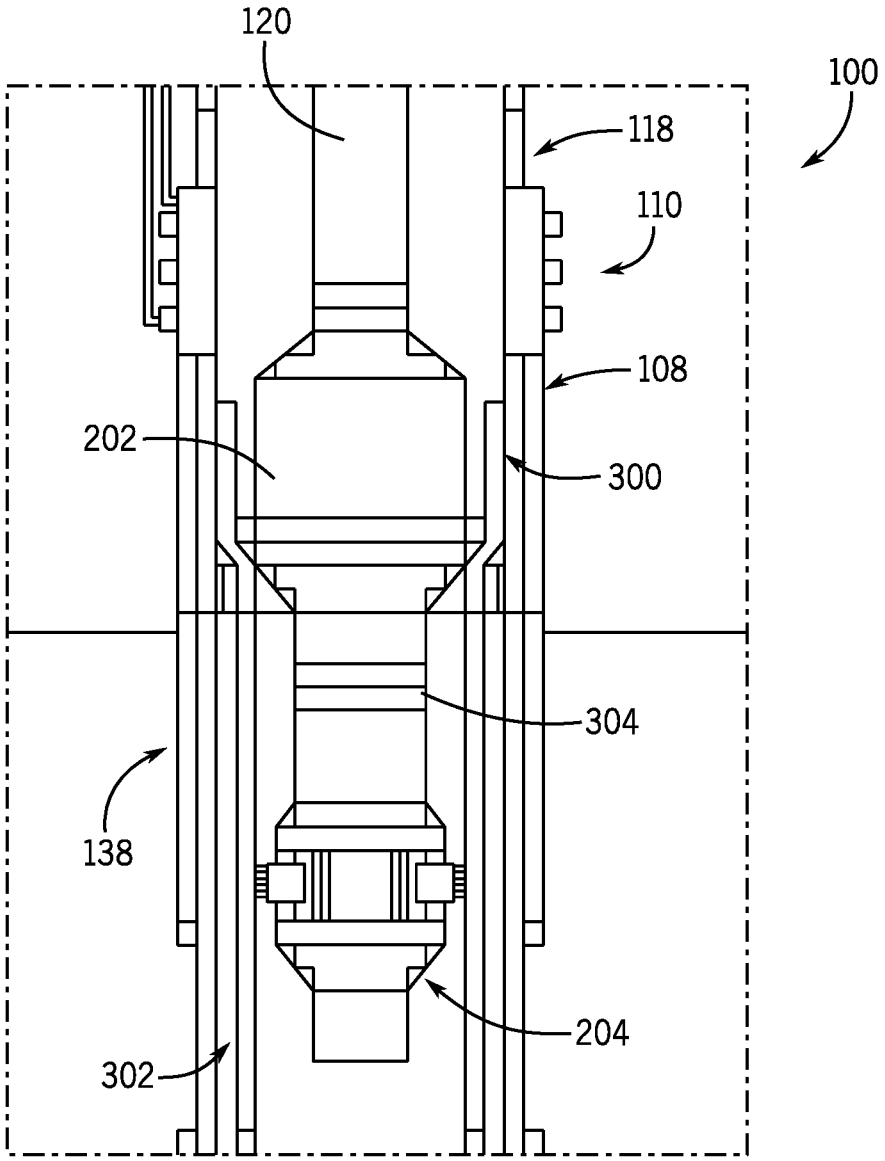
FIG. 3 is a cross-sectional schematic view of an embodiment of a tool system within a wellbore, in accordance with embodiments of the present disclosure.

FIG. 3 is a schematic cross-sectional view of an embodiment of the offshore drilling operation 100. In particular, the illustrated embodiment shows the wellhead 108 and the BOP assembly 110 at the sea floor 136. The illustrated wellbore 106 includes casing 138 (e.g., concrete casing). Furthermore, positioned within the wellhead 106 is a casing hanger 300, which may be similar to the hanger 208. In this example the drill string 120 is coupled to the PADPRT 202, which may be used to land the casing hanger 300 within the wellhead 106. As a result, the a tubular casing 302 may extend from the from the casing hanger 300 to facilitate extension of the wellbore 108.

In this example, the RCTD 204 is coupled to the PADPRT 202 via an emergency release cut sub 304. It should be appreciated that the cut sub 304 is shown for illustrative purposes and may be omitted in various embodiments. The cut sub 304 may enable operators to remove the RCTD 204 from the drill string 120, for example in the event that there is an operational upset. As will be described below, the RCTD 204 may include one or more extendable features that engage the casing 302 to enable torque transmission to the casing 302, which may facilitate movement through narrowed or otherwise stuck points while the casing 302 is installed within the wellbore 106.

FIGS. 4-9 are cross-sectional side views illustrating a sequence of steps to engage and enable casing rotation during installation. Embodiments of the present disclosure may include installation of a casing torque tool, such as the RCTD 204. The RCTD 204 may include keys that engage slots or another engineered profile to facilitate the installation. The tool keys may be set to a retracted position for installation and then extended when positioned at a predetermined location. Extension of the keys may enable rotation of the casing when the casing is run to the bottom and landed. Thereafter, the casing may be secured into position, for example, via a cementing operation.

Figure 4:
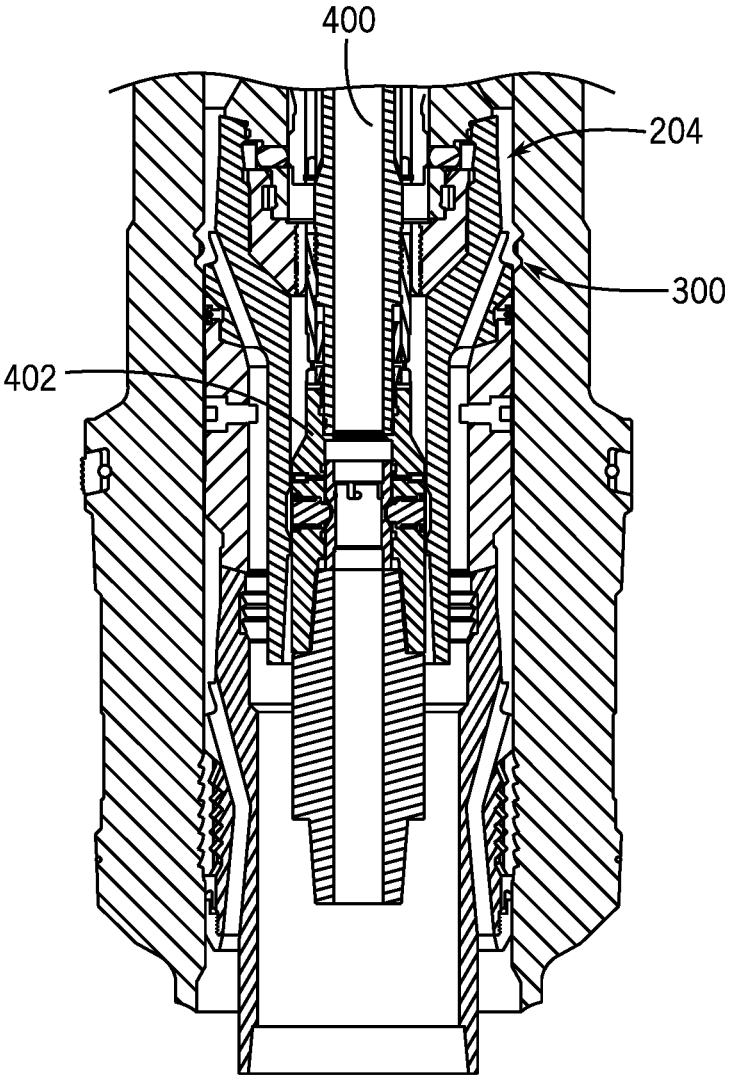
FIG. 4 is a cross-sectional view of an embodiment of a releasable casing torque device (RCTD), in accordance with embodiments of the present disclosure.

FIG. 4 is a cross-sectional side view of an embodiment of the RCTD 204 positioned within the hanger 300. The RCTD 204 may also be referred to as an extension or stinger and is arranged at an end of a running tool 400 to engage an inner wall of the casing string and/or casing hanger 300. In this example, the RCTD 204 includes a body 402 that is coupled to the running tool 400, for example via threads. The threads may be either left handed or right handed threads. It should be appreciated that the direction of the threads may be substantially the same as a desired direction of rotation of the casing hanger 300, such that rotation will not disconnect the RCTD 204 from the casing hanger 300.

Figure 5:
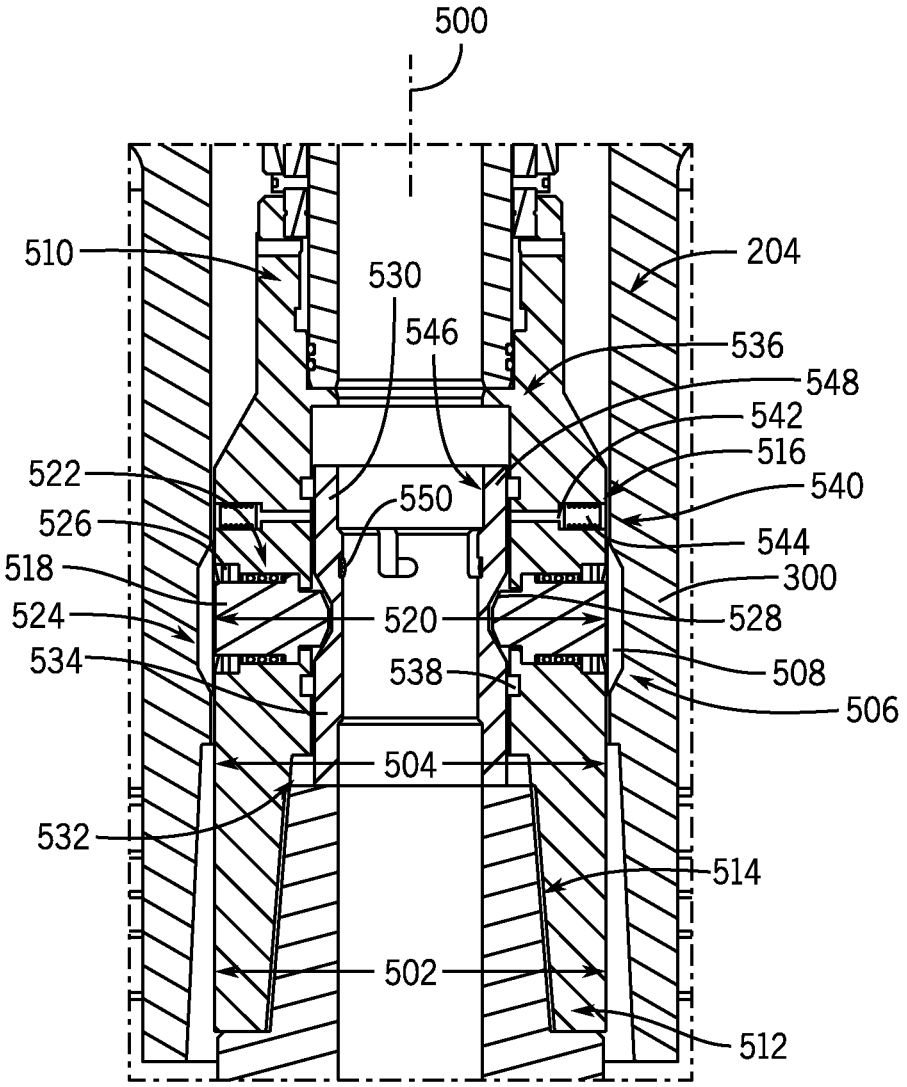
FIG. 5 is a cross-sectional view of an embodiment of a locking mechanism of an RCTD, in accordance with embodiments of the present disclosure.

FIG. 5 is a cross-sectional side view of an embodiment of the RCTD 204 within the casing hanger 300. As shown, the RCTD 204 and the casing hanger 300 are axially aligned along an axis 500 and an outer diameter 502 of the body 402 is smaller than an inner diameter 504 of the casing hanger 300, thereby enabling passage of the RCTD 204 through the casing hanger 300. In this example, the casing hanger 300 includes a profile 506 that, in this example, includes a recess 508 (e.g., key slot). The recess 508 may be an annular recess that extends about a circumference of the inner diameter 504. However, it should be appreciated that the recess 508 may be particularly positioned along the circumference of the inner diameter 504. For example, the recess 508 may be at particularly selected locations that are positioned to align with the body 402 upon rotation to a certain position. It should be appreciated that the profile 506 may be any reasonable shape and that the polygonal shape shown in FIG. 5 is for illustrative purposes only.

In this example, the body 402 includes an upper receptacle 510 (e.g., uphole receptacle, axially higher receptacle, tool receptacle) that receives the running tool 400 and/or may couple to the PADPRT 202. In this example, the running tool 400 extends into the upper receptacle 510 and may be secured via threads, locking members, dogs, or the like. It should be appreciated that a quick release connection may be desirable to facilitate removal and/or disengagement of the RCTD 204. For example, as noted above, the cut sub 304 may facilitate release of the RCTD 204.

The body 402 further includes a lower receptacle 512 (e.g., downhole receptacle, axially lower receptacle, tubular receptacle, extension receptacle) that may be utilized to couple to a segment of tubing, a stab, or the like. For example, a section of tubing, such as production tubing or casing, may be coupled to the lower receptacle 512. Additionally, in various embodiments, other downhole tools may be coupled to the lower receptacle 512 based on operating conditions. In this example, the lower receptacle 512 has a tapered profile 514, as opposed to the upper receptacle 510. Such an arrangement is for illustrative purposes only and various profiles or the like may be incorporated into the respective receptacles 510, 512 to facilitate coupling to downhole equipment.

In various embodiments, the PADPRT 202 may transmit rotation to the RCTD 204 without having the rotation transmitted to the casing hanger 300 because of a gap 516 or space between the RCTD 204 and the casing hanger 300 when the RCTD 204 is shown in the illustrated position where tool keys 518 (e.g., extensions, tongues, spears, etc.) are retracted within the body 402. In other words, in the illustrated embodiment a tool key diameter 520 is less than or equal to the outer diameter 502 of the body 402, thereby permitting free movement of the RCTD 204 with respect to the casing hanger 300. The illustrated tool keys 518 may include an outer profile or shape to facilitate engagement with the recess 508. However, it should be appreciated that the tool keys 518 may be a variety of different shapes and the illustrated polygonal configuration is not intended to be limiting. For example, in various embodiments, the tool key 518 may include spears or stabs at the end to facilitate digging into or engaging the casing 300. As shown, the tool keys 518 are arranged within one or more key recesses 522, which may be annular or in particular locations. For example, the tool keys 518 may be individual components that may be independently moveable, and as a result, may be positioned within individual recesses 522. In other embodiments, the recesses 520 may be joined and form a single annular recess or may form recesses that span a particular circumference of the outer diameter 502.

In the illustrated embodiment, the tool keys 518 form at least a portion of a locking mechanism 524. The locking mechanism 524 may also include one or more biasing members 526, which may drive the tool keys 518 radially inward (e.g., toward the axis 500). In this example, the biasing members 526 are springs, but it should be appreciated that other components may also be utilized in various embodiments, such as shear pins, tethers, and the like.

The tool keys 518 are positioned within a slot 528 (e.g., recess, groove, etc.) formed in a cam 530 extending through the body 402. The cam 530 may be reciprocal along the axis 500 and, upon activation, may be driven in an axially downward direction (e.g., downhole) to drive the tools keys 518 out of the slot 528. As will be shown herein, driving the tool keys 518 out of the slot 528 drives the tool keys 518 into engagement with the casing hanger 300 via the recess 508. In this manner, the RCTD 204 may be set to engage the casing hanger 300.

The illustrated cam 530 includes a variable outer diameter profile 532 that includes a substantially planar sections 534 uphole and downhole of the slot 528. The cam 530 is arranged within a bore 536 of the body 402 and may bear against one or more seals 538 to block fluid flow. For example, the cam 530 may be pressure activated, and allowing fluid flow by the cam 530 of would reduce the force applied to drive the cam 530 in a downward direction. The cam 530 may further be biased in a particular direction. For example, a biasing member may drive the cam 530 in an upward direction and, when overcome, may enable the biasing member 530 to move in a downward direction. Upon removal of the force, the cam 530 may return to the original position. In various embodiments, pin assemblies 540 may be arranged within the body 402 to block movement of the cam 530 in a particular direction. For example, the pin assemblies 540 may include pins 542 and biasing members 544, such as springs, which may extend into the bore 536 to block movement of the cam 530. In various embodiments, the pins 542 may be shear pins that are broken to enable return of the cam 530. In other embodiments, the pins 542 may be driven into the 536 with a particular force that, once overcome, allows retraction of the pins 542.

The illustrated cam 530 also includes a bore 546, which may enable a tool to activate the cam 530. For example, the cam bore 546 includes a notch 548 that may receive a tool. The tool will then bear against a shoulder 550 axially higher than the notch 548, which may facilitate movement of the cam 530, rotation of the cam 530, or the like.

As will be described below, in various embodiments a tool may be utilized to actuate the cam 530. For example, the tool may engage the notch 548 and then the cam 530 may be driven in a direction (e.g., the upward direction, the downward direction, circumferentially) in order to drive the tool keys 518 radially outward. Shifting the cam position may be enabled via the pin assemblies 540, which may engage the cam 530 and block further movement of the cam 530 until subsequent operations are performed. In this manner, the RCTD 204 may be selectively engaged with the casing hanger 300 and released from the casing hanger 300.

Figure 6:
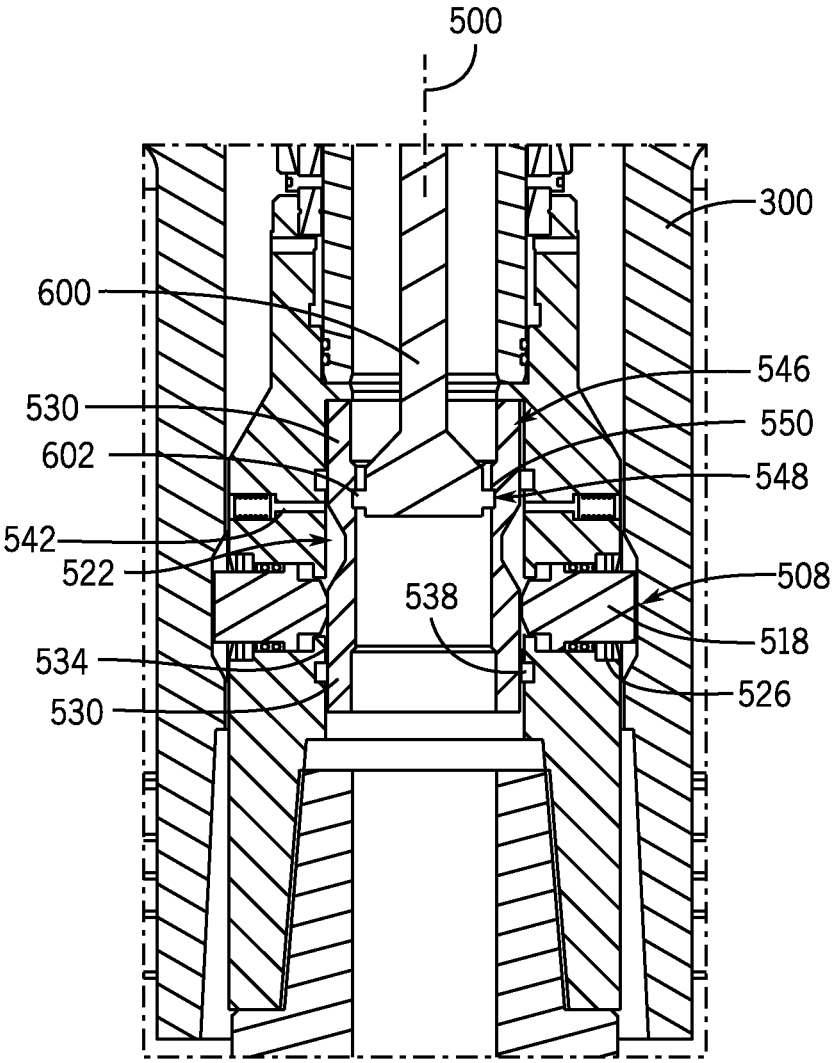
FIG. 6 is a cross-sectional view of an embodiment of a locking mechanism of an RCTD, in accordance with embodiments of the present disclosure.

FIG. 6 is a cross-sectional side view of a later step in the sequence where a tool 600 is installed within the cam bore 546. In this example, the tool 600 includes tool extensions 602 that extend radially outward and engage the notch 548 formed in the bore 546. In various embodiments, the tool extensions 602 may be individual, segmented components that are rotated to align with the shoulder 550. For example, the bore 546 may include a passage (not pictured) to permit axial movement of the tool extensions 602 into the notch 548. Thereafter, the tool 600 may be rotated so that the shoulder 550 blocks axial movement of the tool 600 out of the cam bore 546. Accordingly, an upward force applied to the tool 600 is translated to the cam 530, which moves in an axially upward direction within the bore 536.

As illustrated in FIG. 6, movement of the cam 530 shifts the recess 522 axially upward, such that the tool keys 518 are now positioned against the planar section 534 of the cam 530. Accordingly, the tool keys 518 are driven radially outward and into the recess 508. As noted above, the biasing member 526 may attempt to drive the tool keys 518 radially inward toward the axis 500, however, the cam 530 blocks that movement and, as a result, the tool keys 518 move outward and engage the casing hanger 300 via the recess 508.

The position of the cam 530 is maintained by the pins 542, which extend radially inward into the bore 546 and engage the recess 522. As a result, downward movement of the cam 530 may be blocked until a sufficient force (e.g., downward force) either shears the pins 542 and/or drives the pins 542 radially outward from the bore 546. In this position, the seals 538 continue to provide pressure containment within the wellbore, thereby enabling further operations. In this configuration, the RCTD 204 is secured to the casing hanger 300, and as a result, rotational forces applied to the RCTD 204 will be translated to the casing hanger 300 via the tool keys 518. As a result, sticking points may be addressed using a variety of different methods, as discussed above. It should be appreciated that the tool 600 may be removed after the cam 530 is moved into the position shown in FIG. 6. Additionally, in embodiments, the tool 600 may remain in position to disengage the cam 630.

Figure 7:
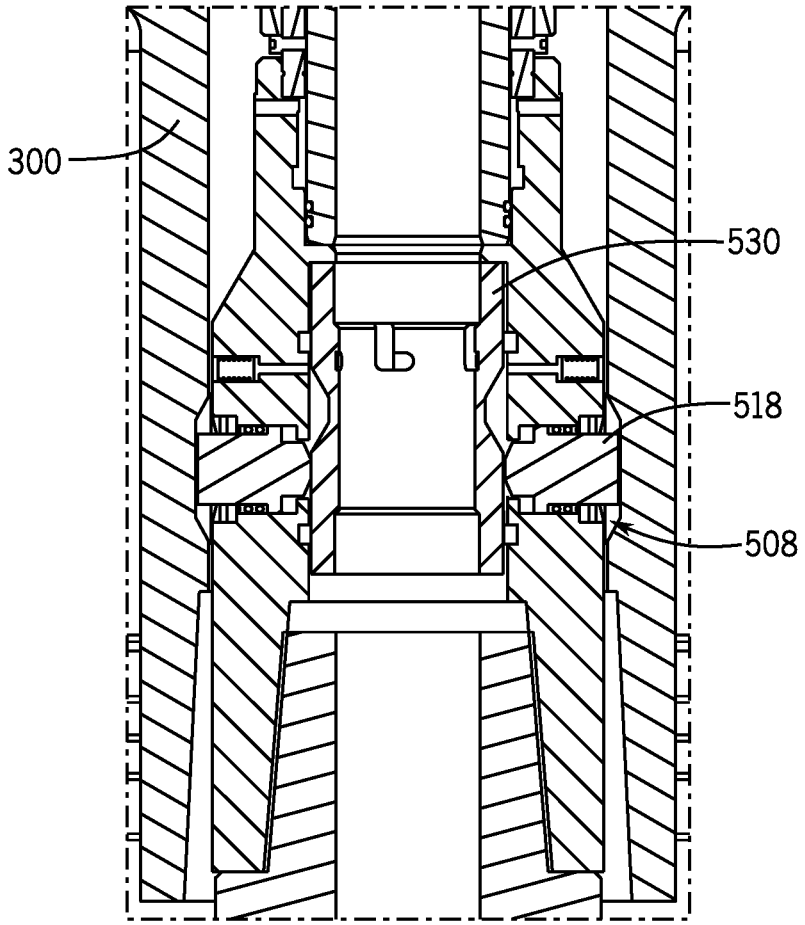
FIG. 7 is a cross-sectional view of an embodiment of a locking mechanism of an RCTD, in accordance with embodiments of the present disclosure.

Wellbore operations may continue until the casing is run to the bottom (or substantially the bottom) of the wellbore. During this tool, the RCTD 204 allows for casing rotation. In various embodiments, the configuration shown in FIG. 6 may be preferred to as a locked position where rotation to the PADPRT 202 is blocked, but torque to the casing string is enabled until the casing hanger is landed. FIG. 7 is a cross-sectional view of an embodiment of the RCTD 204 secured to the casing hanger 300 after removal of the tool 600.

Figure 8:
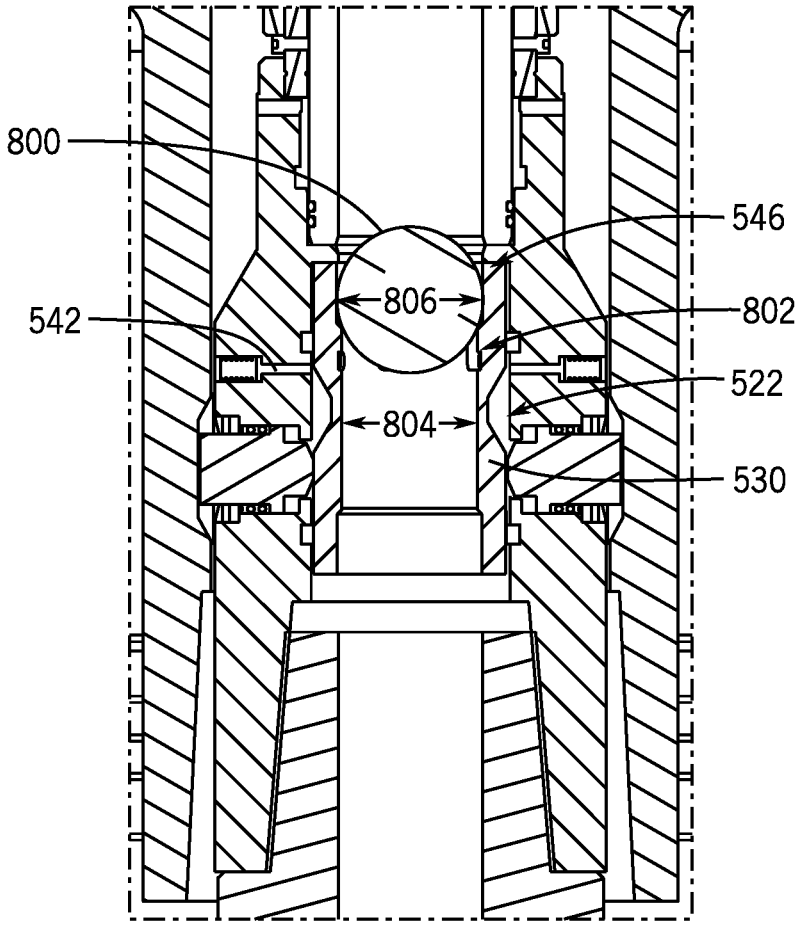
FIG. 8 is a cross-sectional view of an embodiment of a locking mechanism of an RCTD, in accordance with embodiments of the present disclosure.

FIG. 8 is a cross-sectional side view of a later step in the process where a cementing ball 800 is positioned at least partially within the bore 546. For example, after landing the casing hanger, it may be desirable to cement the casing in place. Cement may be pumped down through the drill string and then a plug may follow that drives the cement into an annulus between the formation and the casing. In this example, the ball 800 may be pumped down the drill string and engage the RCTD 204 when the ball 800 contacts the bore 546, which may include a reduced diameter portion 802 that has a diameter 804 less than a ball diameter 806. As a result, the ball 800 may restrict or otherwise block flow into the bore 546.

Figure 9:
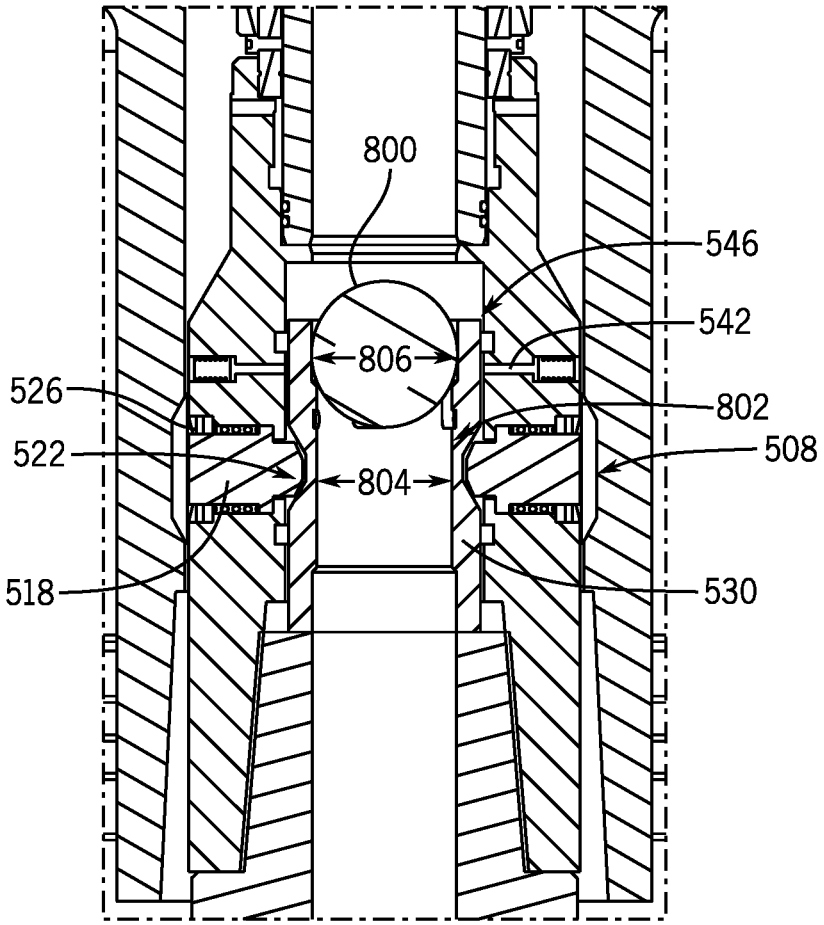
FIG. 9 is a cross-sectional view of an embodiment of a locking mechanism of an RCTD, in accordance with embodiments of the present disclosure.

FIG. 9 is a cross-sectional side view of a later step in the process where pressure is applied to the ball 800, for example by pumping cement down through the drill string. In this example, the pressure applied to the ball 800 is transmitted to the cam 530, which moves axially downward. In other words, the pressure is sufficient to overcome the pins 542, which may retreat radially outward and out of the bore 546. Downward movement of the cam 530 aligns the recess 522 with the tool keys 518. As a result, the biasing member 526 may drive the tool keys 518 radially inward toward the recess 522 and out of contact with the recess 508 of the casing hanger 300. Accordingly, the RCTD 204 is selectively disengaged from the casing hanger 300.

Subsequently, pressure may continue to be applied to either drive the ball 800 through the reduced diameter portion 802. Additionally, the pressure may also break up the ball 800 and/or the composition of the cement and/or fluid may dissolve the ball. As a result, cementing and tool operations may continue.

Figure 10:
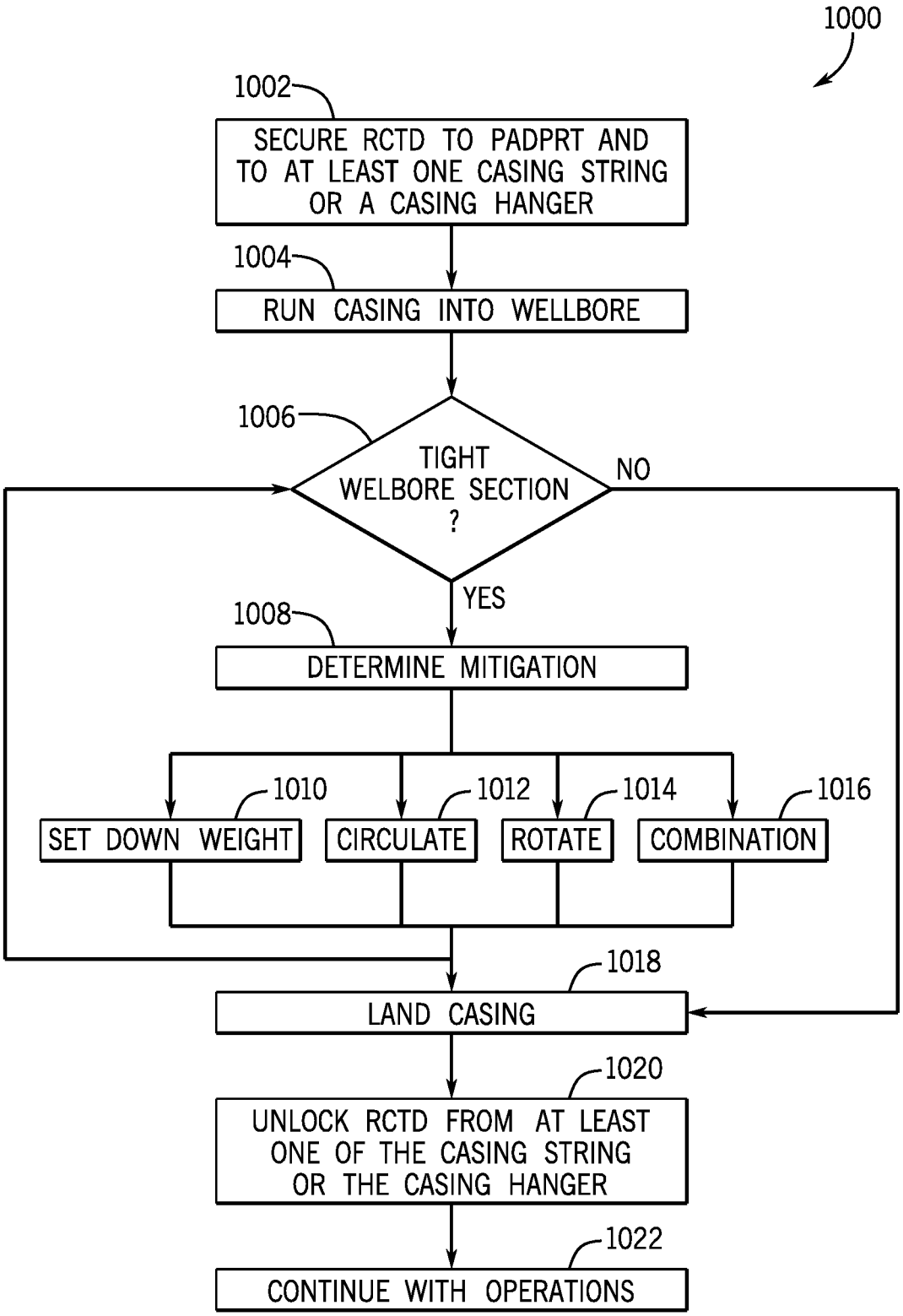
FIG. 10 is a flow chart of an embodiment of a method for transmitting rotation to a casing string, in accordance with embodiments of the present disclosure.

FIG. 10 is a flow chart of an embodiment of a method 1000 for installing a casing hanger and/or section of casing. It should be appreciated that this method, and all methods described herein, may include more or fewer steps. Additionally, the steps may be performed in any order, or in parallel, unless otherwise specifically stated. In this example, the RCTD is secured to the PADPRT and to at least one of a casing string and/or a casing hanger 1002. For example, the RCTD may be threaded to the PADPRT, as shown above, and may be secured to the casing string via the tool keys. In certain embodiments, the connections are formed uphole prior to installation within the wellbore, but it should be appreciated that one or more connections may also be formed downhole. The casing string is run into the wellbore 1004. As noted above, with certain wellbores that may be tight sections or portions where the casing string sticks 1006. If there is no sticking, then operations may commence as usual. If there is sticking, a mitigation strategy is determined 1008.

Embodiments of the present disclosure may enable utilizing of one or more mitigation strategies, which may be performed substantially simultaneously, sequentially, or the like. For example, mitigation may include setting down the weight of the casing string in order to drive the casing into the wellbore 1010. Mitigation may also include circulating drilling fluid to wash the annulus and reduce friction 1012. Additionally, in embodiments, the casing string may be rotated 1014, as described above. In various embodiments, combinations of these strategies may be used 1016. For example, each strategy may be used, some, but not all, may be used, and the like. Mitigation may continue until the casing string moves past the stuck point.

The casing may be landed 1018 and then the RCTD is unlocked 1020. For example, a ball may be dropped in order to disengage the tool keys that contact the casing hanger, among other options to release the RCTD. Accordingly, operations may continue 1022. By way of example, in various embodiments the casing is cemented and specified.

Alternative steps may also include releasing the PADPRT, for example by rotating the PADPRT, lowering the landing string to drive the packoff into the setting position and energize bulk rubber seal on the tool, closing BOP and pressure through choke and kill lines to fully set a metal to metal seal, overpulling to strip a setting sleeve off of packoff and retract a stem, pressure testing the packoff seal through choke & kill lines, releasing the tool from the casing hanger, and then picking up the PADPRT and RCTD for removal from the wellbore.

Figure 11:
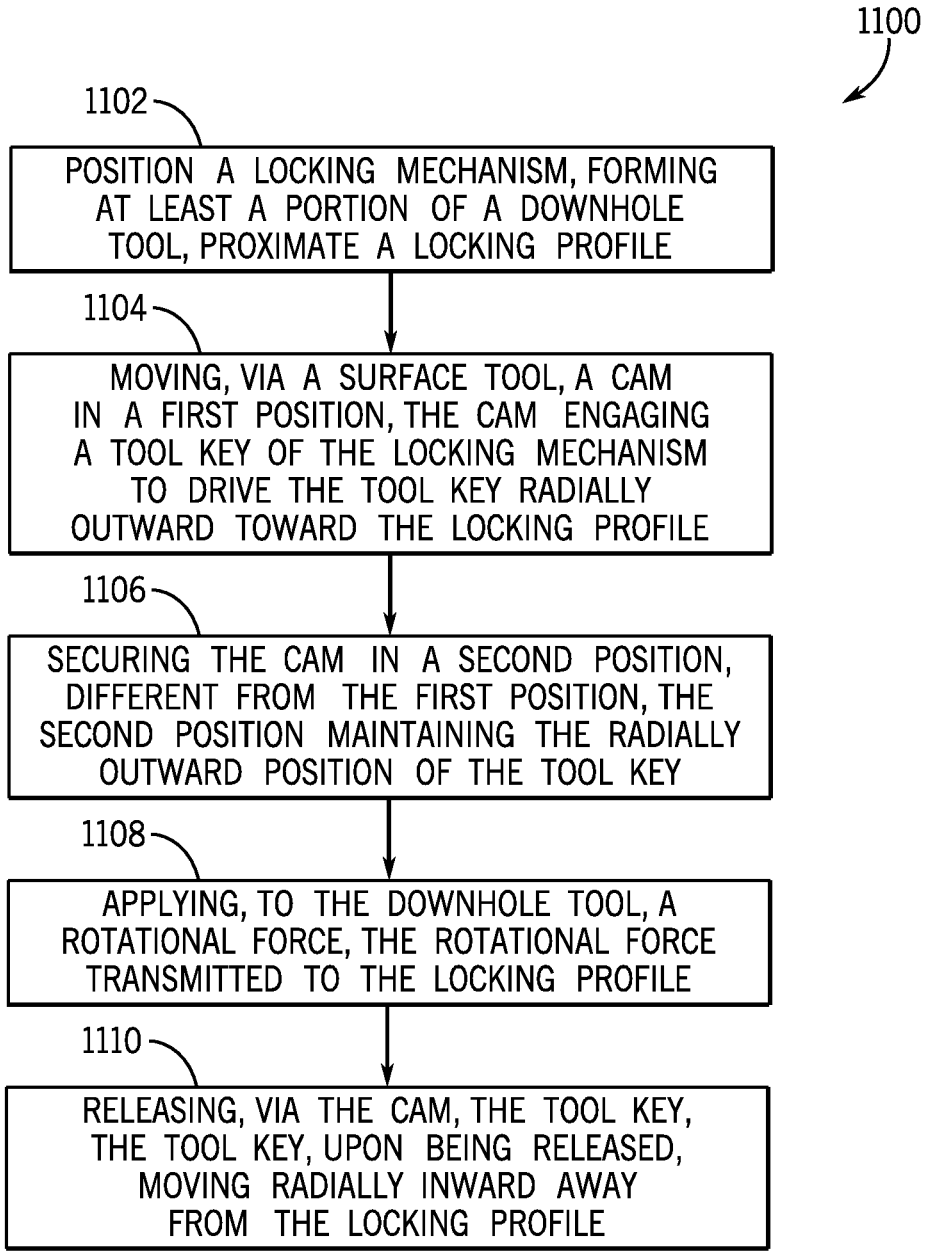
FIG. 11 is a flow chart of an embodiment of a method for transmitting rotation to a casing string, in accordance with embodiments of the present disclosure.

FIG. 11 is a flow chart of an embodiment of a method 1100 for securing a tool to transmit rotation to a casing hanger or string. In this example, a locking mechanism, which forms a portion of a downhole tool, is arranged proximate a locking profile 1102. In various embodiments, the lock profile is a machine profile in a casing hanger or section of casing string. The locking mechanism may engage the locking profile 1104. For example, a surface tool may facilitate radial movement of a tool key to engage the locking profile. The surface tool may engage a cam in a first position and then drive the cam toward a second position to radially move the tool key outward toward the locking profile. The cam may be secured in the second position 1106. As a result, the locking mechanism may be secured to the locking profile such that rotation applied to the locking mechanism is transmitted to the locking profile 1108. The locking mechanism, via the tool key, may be released from the locking profile 1110, which may enable different drilling operations to commence.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A downhole tool for transmitting rotation to a casing string, comprising:

a tool body, the tool body having a bore extending from a first end to a second end;

a cam positioned within the tool body, the cam being axially translatable along an axis of the bore;

a recess, formed in an outer diameter of the cam, the recess having a smaller recess diameter than a planar section of the outer diameter; and a locking mechanism, positioned at least partially within the tool body, the locking mechanism comprising:

a tool key, the tool key being movable between a retracted position where at least a portion of the tool key is positioned within the recess and an extended position where at least a portion of the tool key extends radially outward beyond a tool outer diameter; and a biasing member, the biasing member driving the tool key toward the retracted position.

2. The downhole tool of claim 1, further comprising:

a pin assembly, the pin assembly including a pin biased to extend into the bore, the pin engaging the recess of the cam when the recess is aligned with the pin.

3. The downhole tool of claim 1, further comprising:

a notch formed in a cam bore, the notch being positioned within a reduced diameter portion of the cam bore.

4. The downhole tool of claim 3, wherein the notch is adapted to receive an actuating tool to drive movement of the cam in an axially upward direction.

5. The downhole tool of claim 1, wherein the tool key, when in the extended position, engages a casing recess formed in a casing profile.

6. The downhole tool of claim 1, further comprising:

a seal positioned between the cam and the tool body.

7. The downhole tool of claim 1, further comprising:

a ball positioned within a cam bore, the ball having a ball diameter greater than a cam bore diameter, wherein pressure applied to the ball from an uphole direction drives movement of the cam in an axially downward direction.

* * * * *